United States Patent [19]

Ota

[11] Patent Number: 4,984,923

[45] Date of Patent: Jan. 15, 1991

[54] LIQUID APPLICATOR WITH AXIAL VALUE ACTUATION

[75] Inventor: Yoshiyuki Ota, Aichi, Japan

[73] Assignee: Pilot Ink Co., Ltd., Nagoya, Japan

[21] Appl. No.: 365,321

[22] Filed: Jun. 13, 1989

[30] Foreign Application Priority Data

Jun. 13, 1988 [JP] Japan ..... 63-78098[U]

[51] Int. Cl.[5] ..... A46B 11/00; B43K 8/02

[52] U.S. Cl. ..... 401/279; 222/213; 401/206

[58] Field of Search ..... 401/278, 279, 205, 206, 401/153; 222/510, 213, 518

[56] References Cited

U.S. PATENT DOCUMENTS

| | | | |
|---|---|---|---|
| 523,254 | 7/1894 | Winlkey | 222/213 |
| 1,014,465 | 1/1912 | Hall | 222/213 |
| 2,521,882 | 9/1950 | Swift et al. | 222/510 X |
| 3,087,656 | 4/1963 | Dougherty | 222/518 |
| 3,130,442 | 4/1964 | Kellis | 401/278 X |
| 3,136,457 | 6/1964 | Via, Sr. | 222/510 X |
| 3,154,222 | 10/1964 | Heckman | 401/153 X |
| 3,244,332 | 4/1966 | Rogers | 222/213 |
| 3,515,316 | 6/1970 | Green | 222/213 X |
| 4,043,681 | 8/1977 | Funahashi | 401/153 X |
| 4,867,593 | 9/1989 | Kurokawa et al. | 222/213 X |

FOREIGN PATENT DOCUMENTS

| | | | |
|---|---|---|---|
| 48-16943 | 5/1973 | Japan . | |
| 91589 | 4/1958 | Norway | 401/206 |
| 713 | of 1881 | United Kingdom | 222/213 |
| 2193881 | 2/1988 | United Kingdom | 401/279 |

*Primary Examiner*—Steven A. Bratlie

*Attorney, Agent, or Firm*—Sughrue, Mion, Zinn, MacPeak & Seas

[57] ABSTRACT

In the application instrument provided in accordance with the present invention, an operating member inserted in the middle cylinder so as to be movable backward and forward in the axial direction thereof is operated so that a valve mechanism provided in the front portion of the middle cylinder is operated to supply the penpoint with the applied liquid stored in the rear portion of the middle cylinder. The valve mechanism includes a valve seat having a valve hole, a valve spindle provided with a valve element for opening and closing the valve hole, and a stretchable member for moving the valve spindle backward and forward. The stretchable member is elongated and shortened in the axial direction of the middle cylinder as the bent portions of the bent arms are bent less and more, respectively. The operating member is disposed behind the valve mechanism. An operating element provided at the rear end of the middle cylinder is operated to move the operating member forward to push the bent portions of the bent arms to elongate the stretchable member so that the valve spindle is moved backward to open the valve hole to supply the applied liquid to the penpoint.

8 Claims, 3 Drawing Sheets

LIQUID APPLICATOR WITH AXIAL VALUE ACTUATION

BACKGROUND OF THE INVENTION

The present invention relates to a liquid applicator and more particularly to a light weight application instrument from which a relatively viscous liquid, such as a manicure liquid, a liner liquid a lip color liquid, a paint, a marking liquid a letter correction liquid and an adhesive for a plastic model, flows out at a constant rate for application or writing.

A conventional application instrument, in which a push rod in the middle cylinder moves forward to open a valve to supply an applied liquid to a penpoint, is disclosed in Japanese Utility Model Application No. 16943/73.

One problem with such conventional instruments is that when the pressure in the applied liquid container rises the pressure acts on the valve in such a direction as to open the valve, thereby supplying the applied liquid to a liquid guide core so that the applied liquid is likely to drop in the form of a globule, although the push rod is not moved forward. Another problem is that since the push rod is inserted in the center of the applied liquid container the diameter of a ball for stirring the applied liquid is so small that the stirring of the liquid is insufficient.

SUMMARY OF THE PRESENT INVENTION

An object of the present invention is to solve the above problems. Accordingly, this and other objects are carried out by the provision of an application instrument in which a valve is maintained closed despite a rise in the pressure in an applied liquid container, thereby preventing the applied liquid from dropping in the form of a globule from a penpoint, and a ball capable of sufficiently stirring the applied liquid can be housed in the middle cylinder.

In the application instrument provided in accordance with the present invention, an operating member inserted in the middle cylinder so as to be movable backward and forward in the axial direction thereof is operated so that a valve mechanism provided in the front portion of the middle cylinder is operated to supply the penpoint with the applied liquid stored in the rear portion of the middle cylinder. The valve mechanism includes a valve seat having a valve hole a valve spindle provided with a valve element for opening and closing the valve hole, and a stretchable member for moving the valve spindle backward and forward. The stretchable member has at least two bent arms including bent portions. The stretchable member is elongated and shortened in the axial direction of the middle cylinder as the bent portions of the bent arms are bent less and more, respectively. The stretchable member is secured at one end thereof to the valve seat and at the other end of the member to the valve spindle. The operating member, whose front portion has an inscribed circle whose diameter is smaller than that of a circle circumscribed on the bent portions of the bent arms of the stretchable member, is disposed behind the valve mechanism. An operating element provided at the rear end of the middle cylinder is operated to move the operating member forward to push the bent portions of the bent arms to elongate the stretchable member so that the valve spindle is moved backward to open the valve hole to supply the applied liquid to the penpoint. Although stress for putting the valve element in contact with the valve seat to close the valve hole is always applied to the valve mechanism, the valve element can be lightly opened from the valve seat due to the action of the stretchable member.

DETAILED DESCRIPTION OF A PREFERRED EMBODIMENT

An embodiment of the present device is hereafter described with reference to the drawings attached hereto.

Figure 1:
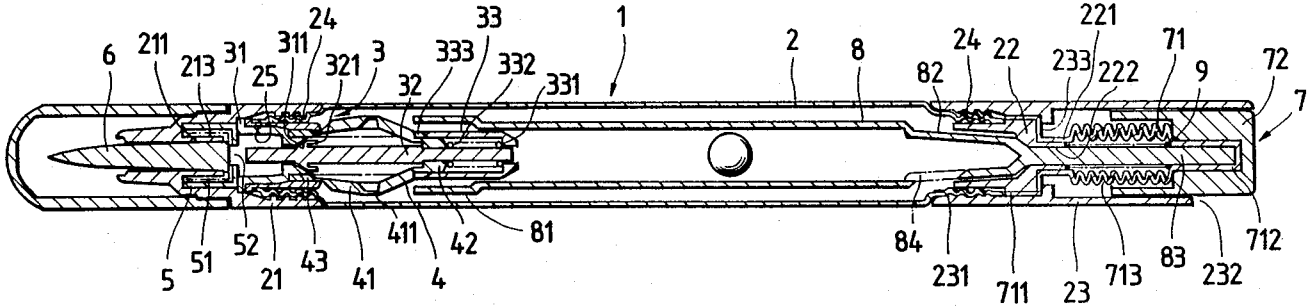
FIG. 1 is a longitudinal sectional view of an application instrument in accordance with a preferred embodiment of the present invention device.

FIG. 1 is a longitudinal sectional view of a preferred embodiment of the application instrument 1. With reference to FIGS. 1 through 6, the application instrument 1 comprises a middle cylinder 2, a valve mechanism 3 a stretchable member 4, a support member 5 a penpoint 6, an operating element 7, an operating member 8, a front cylinder 21, a fitted cylinder 22 and a protective cylinder 23. The valve mechanism 3 includes a valve seat 31 having a valve hole 311 in the center of the valve seat, a valve spindle 32 provided with a hemispherical valve element 321 at the front portion of the valve spindle, a spring bearer 33 having four applied liquid passage holes 333 in the circumferential wall of the spring bearer and having a spring support surface 331 on the inside wall of the rear portion of the spring bearer, and a stretchable member 4 having a small cylindrical secured portion 42 at the rear end of the stretchable member and a large-diameter cylindrical secured portion 43 at the front end of the member and having bent arms 41 extending in mutually opposite positions between both the cylindrical secured portions and having bent portions 411 nearly at the middle of the bent arms. Each of the valve spindle 32 the valve seat 31, the spring bearer 33, and the stretchable member 4 is made of plastic by injection molding.

Before the stretchable member 4 is inserted into the spring bearer 33 in assembling the application instrument 1, the valve spindle 32 is fitted in the cylindrical secured portion 42 of the stretchable member and the small-diameter cylindrical portion of the valve seat 31 is fitted in the other cylindrical secured portion 43 of the stretchable member. When the stretchable member 4 is inserted into the spring bearer 33, the rear end of the stretchable member is engaged with one end of a spring 332 so that the bent portions 411 of the member project from the applied liquid passage holes 333 and the other end of the spring is in contact with the spring support surface 331 of the spring bearer. The large-diameter portion of the valve seat 31 is fitted in the opening of the front end of the spring bearer 33. As a result, the valve mechanism 3 is constituted.

The front cylinder 21 has a penpoint holding portion 211 at the front end of the cylinder, and has four applied liquid guide grooves 212 at the rear end of the penpoint holding portion. An applied liquid reservoir 213 is provided around the applied liquid guide grooves 212. After the penpoint 6 is inserted into the penpoint holding portion 211, the support member 5 having an applied liquid passage hole 52 in the center of the member and applied liquid guide grooves 51 in the inside surface of the member is fitted in the applied liquid reservoir 213 so that the penpoint is secured.

The operating member 8 comprises a cylindrical portion 81, a conical portion 82 extending from the rear end of the cylindrical portion, and a stick 83 extending from the rear end of the conical portion. The conical portion 82 has three liquid passage holes 84.

The fitted cylinder 22 is a stepped cylinder and has a small-diameter portion 221 having a center hole 222 through which the stick 83 of the operating member 8 slides. The outside diameter of the body of the fitted cylinder 22 is slightly decreased gradually from the rear end of the body toward the front end thereof so that the cylinder can be smoothly fitted in the middle cylinder 1.

The application instrument 1 includes a bellows member 71 having a large-diameter portion 711 at the front open end of the member, a covering portion 712 located at the rear closed end of the member and covering the stick 83 of the operating member 8, and a bellows 713 extending between the large-diameter portion and the covering portion.

After the stick 83 of the operating member 8 is inserted into the center hole 222 of the fitted cylinder 22 so as to be slidable in the center hole, the large-diameter portion of the fitted cylinder is fitted in the rear end of the middle cylinder 2 having open portions 25 located at the front and rear ends of the middle cylinder and provided with male screws 23. The front open end of the bellows member 71 containing a spring 9 is then fitted over the large-diameter portion of the fitted cylinder 22. After that the protective cylinder 23 having a female screw 231 on the inside surface of the front portion of the cylinder and a notch 232 in the rear portion of the cylinder is engaged with the rear male screw 24 of the middle cylinder 2 and secured thereto by an adhesive. The bellows member 71 is placed in watertight pressure contact with the fitted cylinder 22 so that a pressure contact section 233 is constituted inside the protective cylinder 23. An operating rod 72 is then press-fitted on the covering portion 712 of the bellows member 71 so that the operating element 7 is constituted After the valve mechanism 3 is fitted in the middle cylinder 2 at the front open end thereof, the front cylinder 21 fitted with the penpoint 6 is screw-engaged in the front open end of the middle cylinder and secured thereto by an adhesive. The application instrument 1 is thus constituted.

Figure 2:
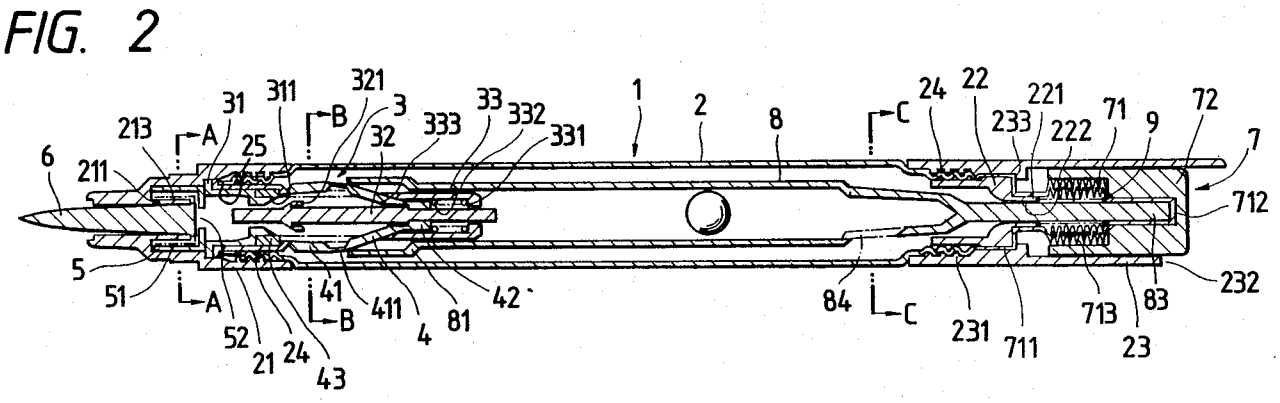
FIG. 2 is a longitudinal sectional view of the application instrument with its valve hole open.
Figure 5:
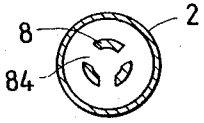
FIG. 5 is a cross-sectional view of the application instrument along line C—C of FIG. 2.
Figure 4:
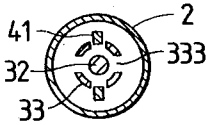
FIG. 4 is a cross-sectional view of the application instrument along line B—B of FIG. 2.
Figure 3:
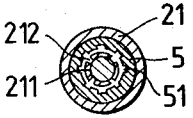
FIG. 3 is a cross-sectional view of the application instrument along a line A—A of FIG. 2.

When the operating rod 72 is pushed forward, as shown in FIG. 2, the operating member 8 is moved forward into contact with the stretchable member 4 to push the bent portions 411 thereof to elongate the stretchable member in the axial direction of the application instrument 1. As a result, the valve spindle 32 is moved back so that the valve element 321 is opened from the valve seat 31. At the same time the bellows member 71 is compressed so that the internal capacity of the middle cylinder 2 is reduced to increase the pressure therein to supply an applied liquid to the penpoint 6.

The operating member 8 is moved backward and forward by manipulating the operating element 7 provided at the rear end of the middle cylinder 2. When the operating member 8 is moved forward, it pushes the stretchable member 4 to elongate it. The front end portion B1 of the operating member 8 is shaped as a cylinder as shown or may be provided with operating parts the number of which is not smaller than that of the bent arms 41 of the stretchable member 4. The cylindrical body of the operating member 8 has at least one liquid passage hole 84 in the circumferential wall of the body so that the interior of the body communicates with that of the middle cylinder 2. As a result, a stirring ball provided in the cylindrical body of the operating member 8 exerts a stirring effect upon the interior and exterior of the cylindrical body to sufficiently stir the applied liquid.

The operating element 7 of the application instrument 1 provided in accordance with the present device is pushed to move the operating member 8 forward into contact with the bent portions 411 of the bent arms 41 of the stretchable member 4 to push it so that the stretchable member 4 is elongated as the bent portions are bent less As a result, as shown in FIG. 2, the valve spindle 32 is pushed backward in the middle cylinder so that the valve element 321 is separated from the valve seat 31 at the valve hole 311 to open it to let the applied liquid flow out. When the pushing of the operating element is stopped, the element is moved backward by spring 9 and 332 to shorten the stretchable member 4 into the original posture thereof as shown in FIG. 1. At the same time, the valve spindle 32 is moved forward to put the valve element 321 into pressure contact with the valve seat 31 at the valve hole 311 to close the hole. As a result the applied liquid stops flowing out.

Figure 6:
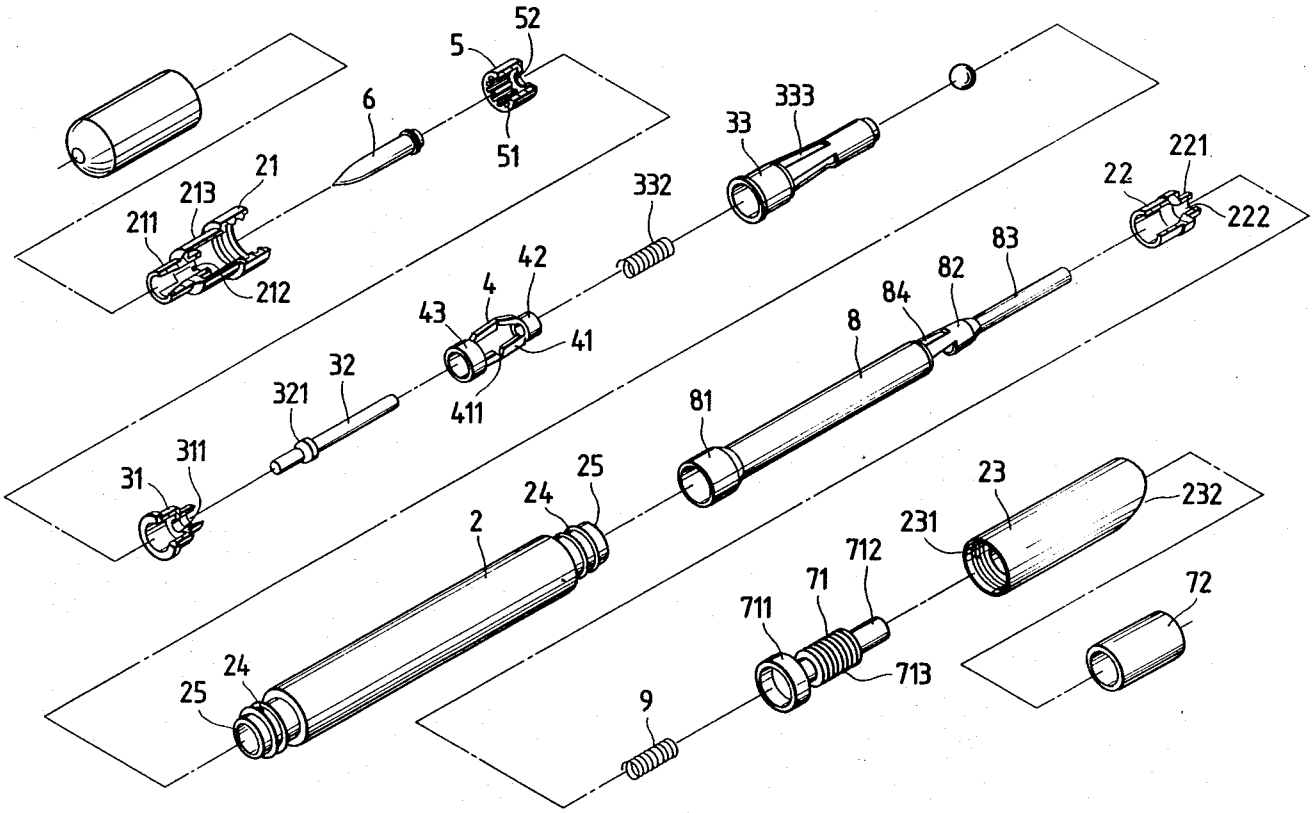
FIG. 6 is a perspective cutaway exploded view of the application instrument.
Figure 7:
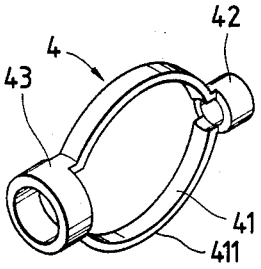
FIGS. 7, 8 and 9 are perspective views of modifications of the stretchable member of the application instrument.
Figure 9:
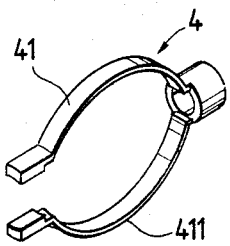
Figure 8:
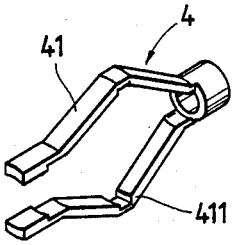
Figure 10:
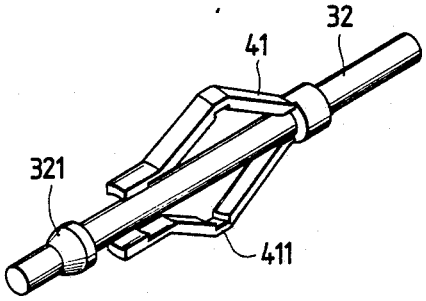
FIG. 10 is a perspective view of the valve spindle and stretchable member of a modification of the application instrument.

The stretchable member of FIGS. 1, 2 and 6 has arms having bent portions and extending from the butt of the member in the axial direction of the application instrument and can be elongated in the axial direction by being pushed in the radial direction of the instrument. The stretchable member is made of plastic, metal or the like. Alternative stretchable members 4 are shown in FIGS. 7. 8 and 9. Also, the stretchable member can be made of plastic by injection molding or the like integrally with the valve spindle, as shown in FIG. 10. The spring 332 (FIG. 6) is provided behind the stretchable member 41 in order to help the member return to the original position thereof when the pushing of the member in the radial direction of the application instrument is stopped. However, if the stretchable member is of high resilience a spring 332 need not be provided.

The penpoint 6 can be made of a soft material such as hair and rubber a material such as plastic and fibers or a hard material such as ceramic and stainless steel. The invention herein is independent of the quality, form and strength of the penpoint The operating rod 72 of the operating element 7 is pushed to move the operating member 8 forward or backward. Alternatively, it may be rotated to operate a cam to move the operating member 8 forward or backward.

What is claimed is:

1. A liquid applicator for dispensing liquid from a middle cylinder thereof to a penpoint thereof comprising:

a middle cylinder; an operating member within said middle cylinder and movable forward and backward axially within said middle cylinder; a valve mechanism provided in a front portion of said middle cylinder; and a penpoint positioned to receive liquid dispensed from a rear portion of said middle cylinder via said valve mechanism;

said valve mechanism comprising, a valve seat having a valve opening; a valve spindle having a valve element for blocking and opening said valve opening as said valve spindle is moved forward toward said valve seat and backward away from said valve seat, respectively; a stretchable member having a forward end connected to said valve seat, a rear end connected to said valve spindle, and a stretchable central portion; said valve seat being fixed with respect to said middle cylinder;

an operating element for interacting with said operating member to move said operating member axially; said operating member having an engaging portion which engages said stretchable portion to elongate said stretchable member when said operating member is moved forward axially to cause said rear end of said stretchable member and said valve spindle to move axially backward thereby opening said valve opening.

2. A liquid applicator as claimed in claim 1, wherein said stretchable portion comprises bent arms having bent portions, and said operating member has a front portion with an inner diameter that is smaller than a circle circumscribed on said bent portions; said stretchable member being biased to normally have a reduced length with said bent arms being in the most bent positions; and said front portion of said operating member engaging said bent portions when said operating member is moved forward to elongate said stretchable member and move said valve spindle and said valve element rearward said valve element being pressed against said valve seat to close said valve opening when said stretchable member is in its normal position.

3. A liquid applicator as claimed in claim 2, wherein said operating member is shaped as a cylinder and has openings therein for the passage of said liquid.

4. A liquid applicator as claimed in claim 2, wherein said stretchable member is formed integrally with said valve spindle.

5. A liquid applicator as claimed in claim 2 further comprising a liquid reservoir between said penpoint and said valve mechanism for holding said liquid passed through said valve opening.

6. A liquid applicator of the type having a liquid container in the rear portion of said applicator, a penpoint in the front section of said applicator, a valve seat having an opening for passing liquid from said container to said penpoint, a valve element adapted to engage and disengage said valve seat for closing and opening said valve, respectively, and an operating member for moving axially in said applicator for controlling the opening and closing of said valve opening; the improvement comprising, said valve element being downstream of said valve seat; and stretchable means intermediate said operating member and said valve seat for moving said valve element rearwardly away from said valve seat when said operating member moves forwardly, and moving said valve element forward toward said valve seat when said operating member moves rearwardly.

7. A liquid applicator as claimed in claim 6, wherein said stretchable means comprises a stretchable member having one end fixed in position in said applicator relative to said valve seat, a second end fixed to said valve element and movable axially in said applicator, in a middle portion comprising bent arms which can be straightened by pressure to move said second end rearwardly in said applicator.

8. A liquid applicator as claimed in claim 7, wherein said operating member has a portion which engages said bent arms and puts pressure thereon to tend to straighten said bent arms when said operating member moves forward.

* * * * *